United States Patent [19]

Moss et al.

[11] Patent Number: 4,934,256

[45] Date of Patent: Jun. 19, 1990

[54] FUME HOOD VENTILATION CONTROL SYSTEM

[75] Inventors: Charles A. Moss, Lee's Summit; James F. Ptacek, Kansas City, both of Mo.

[73] Assignee: Labconco Corporation, Kansas City, Mo.

[21] Appl. No.: 311,148

[22] Filed: Feb. 14, 1989

[51] Int. Cl.[5] ..... B08B 15/02

[52] U.S. Cl. ..... 98/115.3

[58] Field of Search ..... 98/115.1, 115.3, 1.5

[56] References Cited

U.S. PATENT DOCUMENTS

| | | | |
|---|---|---|---|
| 3,072,038 | 1/1963 | Phillips . | |
| 3,084,711 | 4/1963 | Phillips | 137/521 |
| 3,211,177 | 10/1965 | Phillips | 137/604 |
| 3,295,432 | 1/1967 | Palmquist . | |
| 3,685,355 | 8/1972 | DeBaun | 73/212 |
| 3,874,754 | 4/1975 | Saunder et al. | 98/115.3 X |
| 3,945,565 | 3/1976 | Lynch . | |
| 4,040,564 | 8/1977 | Waeldner . | |
| 4,067,377 | 1/1978 | Phillips | 160/98 |
| 4,160,407 | 7/1979 | Duym | 98/115.3 X |
| 4,284,237 | 8/1981 | Harris . | |
| 4,377,969 | 3/1983 | Nelson | 98/115.3 |
| 4,466,341 | 8/1984 | Grogan | 340/611 X |
| 4,517,883 | 5/1985 | Levchenko et al. | 98/115.3 |
| 4,528,898 | 7/1985 | Sharp | 98/115.3 |
| 4,706,553 | 11/1987 | Sharp et al. | 98/115.3 |
| 4,741,257 | 5/1988 | Wiggin et al. | 98/115.3 |

FOREIGN PATENT DOCUMENTS

| | | | |
|---|---|---|---|
| 2072331 | 9/1981 | United Kingdom | 98/115.3 |
| 2076145 | 11/1981 | United Kingdom | 98/115.3 |
| 2097527 | 11/1982 | United Kingdom | 98/115.3 |

*Primary Examiner*—Harold Joyce

*Attorney, Agent, or Firm*—Kokjer, Kircher, Bradley, Wharton, Bowman & Johnson

[57] ABSTRACT

A method and apparatus for controlling ventilation of a laboratory fume hood. The face velocity of air entering the fume hood is sensed by a velocity sensor, and a stepping motor controls damper blades in the exhaust duct to normally maintain the face velocity at a nearly constant level. A potentiometer senses the position of a sash that controls the fume hood face opening. When the sash is 40% open or less, the damper blades are adjusted to keep the volume rate of flow through the fume hood nearly constant. An alarm signal is generated if the flow is unduly low. The damper blades are fully opened either if a switch is operated or if the sash is abruptly opened. An unoccupied mode permits reduced air flow when the sash is nearly closed and the laboratory is unoccupied.

18 Claims, 4 Drawing Sheets

FUME HOOD VENTILATION CONTROL SYSTEM

BACKGROUND OF THE INVENTION

This invention relates generally to laboratory fume hoods and more particularly to a method and apparatus for controlling the ventilation of a fume hood.

Many types of potentially harmful materials are handled in laboratories in fume hoods. An exhaust fan pulls air through the fume hood to make certain that fumes do not leak into the laboratory where they could be inhaled by personnel working in the vicinity. The materials in the fume hood are accessible through an opening which is controlled by a movable sash. The sash usually slides up and down to control the exposure of the fume hood opening.

In order to assure safe conditions, the velocity of the air entering the fume hood (referred to as the face velocity) must be maintained high enough to keep fumes from leaking into the room, yet it should not be so high that it creates turbulent conditions which can lead to the escape of contaminants. Thus, the face velocity should be maintained nearly constant and the velocity level should not vary appreciably throughout the normal working range of the sash. Since raising of the sash increases the effective size of the fume hood opening, the volume of air pulled through the hood must be increased in order to maintain a constant face velocity as the sash is raised. For most materials that are handled in fume hoods, a face velocity of approximately 100 feet per minute is satisfactory.

As the sash is lowered to restrict the hood opening, the volume rate of air flow can be decreased. However, maintaining a constant face velocity as the sash is lowered results in a progressively lower volume rate of air flow through the fume hood. When the sash is nearly closed, the volume of air flow can be so low that dangerous conditions can be created. Consequently, the volume rate of air flow through the fume hood should be maintained at or above a minimum level regardless of the position of the sash.

Another situation that can be dangerous occurs when the sash is opened abruptly. In this event, it takes some time for the face velocity to decrease and it takes additional time for the control system to sense the decreased face velocity and take appropriate action such as increasing the blower motor speed or opening a damper in the exhaust duct. The delay can be long enough to allow harmful fumes to escape from the hood.

Because the air which is drawn through the fume hood is heated or cooled air from within the building, the building energy requirements are increased with increasing amounts of air drawn through the fume hood. Therefore, it is desirable to minimize the air requirements of the hood, particularly overnight and on weekends when there are no personnel working in the laboratory and cut back of the air flow is feasible. However, it is important from a safety standpoint to make certain that the air flow is sufficient whenever the laboratory is occupied.

In the event of a blower failure or other malfunction in the exhaust system, the lack of ventilation of the fume hood can endanger personnel in the laboratory and they should be immediately alerted to the danger. Also, if power fails in an installation having a closed or partially closed damper in the exhaust duct, the restriction in the exhaust system can cause contaminants to leak into to the laboratory in large quantities. If an accidental spill or other emergency arises, contaminants are not quickly evacuated from the laboratory if the exhaust duct happens to be restricted at the time.

SUMMARY OF THE INVENTION

The present invention has, as its principal goal, the provision of an improved control system for fume hood ventilation which operates the fume hood in a safe, effective and energy efficient manner.

More specifically, it is an important object of the invention to provide a method and apparatus for controlling fume hood ventilation in a manner to maintain a substantially constant face velocity when the sash is opened more than a preselected amount and to otherwise maintain a substantially constant volume rate of air flow. By virtue of this manner of operation of the fume hood, the face velocity is normally maintained constant but is increased to keep the volume rate of flow above a safe level when the sash is lowered beyond a preselected position, such as 40% open, for example.

Another object of the invention is to provide a method and apparatus of the character described wherein an alarm signal is generated when the face velocity drops to an unacceptably low level. It is a particular feature of the invention that when an alarm condition has occurred, an indication to that effect is given even if the face velocity thereafter returns to its normal range. Consequently, laboratory personnel are alerted to the fact that there was an alarm condition and that there is perhaps a problem that requires attention.

A further object of the invention is to provide a method and apparatus of the character described in which the face velocity setting and the permitted range of its fluctuation from the set velocity are both adjustable.

Yet another object of the invention is to provide a method and apparatus of the character described in which the exhaust control damper is immediately opened fully if the sash is abruptly raised.

A still further object of the invention is to provide a method and apparatus of the character described which allows operation of the fume hood in an unoccupied mode with reduced ventilation to conserve energy when the laboratory is not occupied. Additionally, the unoccupied mode is only permitted when the sash is nearly fully closed, and the normal operating mode is entered automatically if the sash is raised.

An additional object of the invention is to provide a ventilating system damper control arrangement which permits the damper to immediately spring to the fully open position when its control motor is deenergized. As a consequence, the damper can be immediately opened if necessary, such as when the sash is abruptly raised or when an accidental spill occurs and immediate maximum ventilation is in order.

Additional features of the invention include the generation of a signal indicative of the amount of air passing through the fume hood and the visual display of various operating parameters such as the energy used, the presence or absence of an alarm condition, whether the fume hood is operating in the occupied or unoccupied mode, and whether the face velocity is in the normal range or above or below normal.

BRIEF DESCRIPTION OF THE DRAWINGS

In the accompanying drawings in which like reference numerals are used to indicate like parts in the various views.

DETAILED DESCRIPTION OF THE INVENTION

Figure 2:
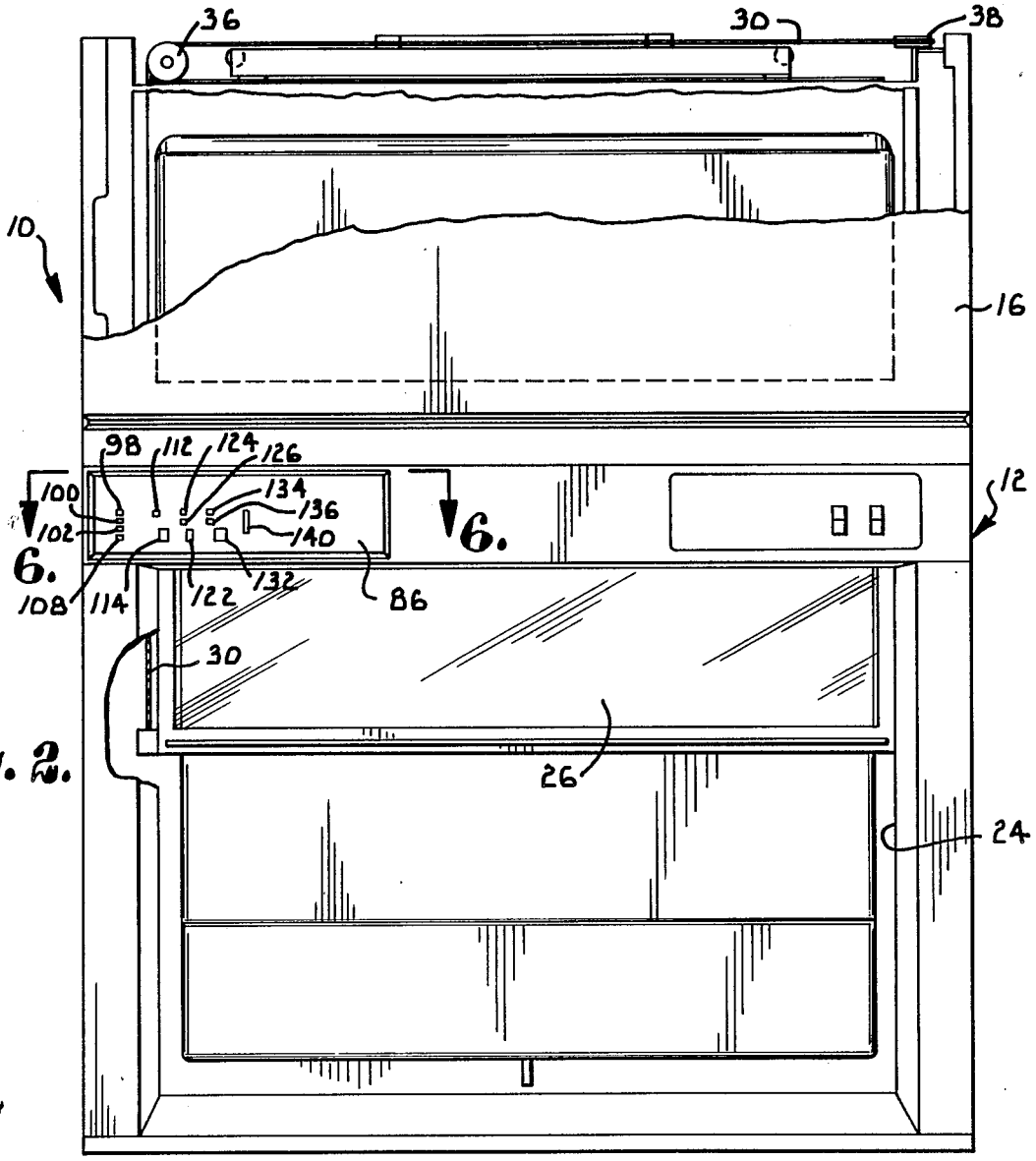
FIG. 2 is a front elevational view of the fume hood on an enlarged scale, with portions broken away for purposes of illustration.
Figure 1:
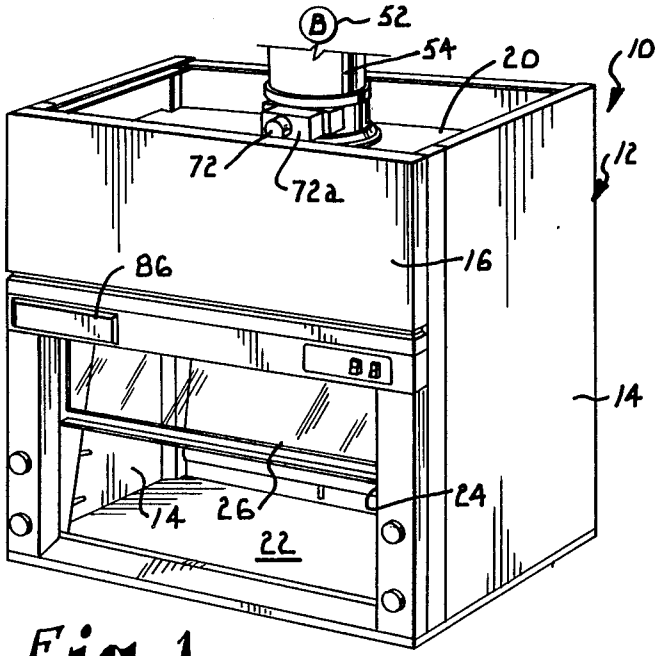
FIG. 1 is a front perspective view of a fume hood which is equipped with a ventilation control system in accordance with the present invention.
Figure 3:
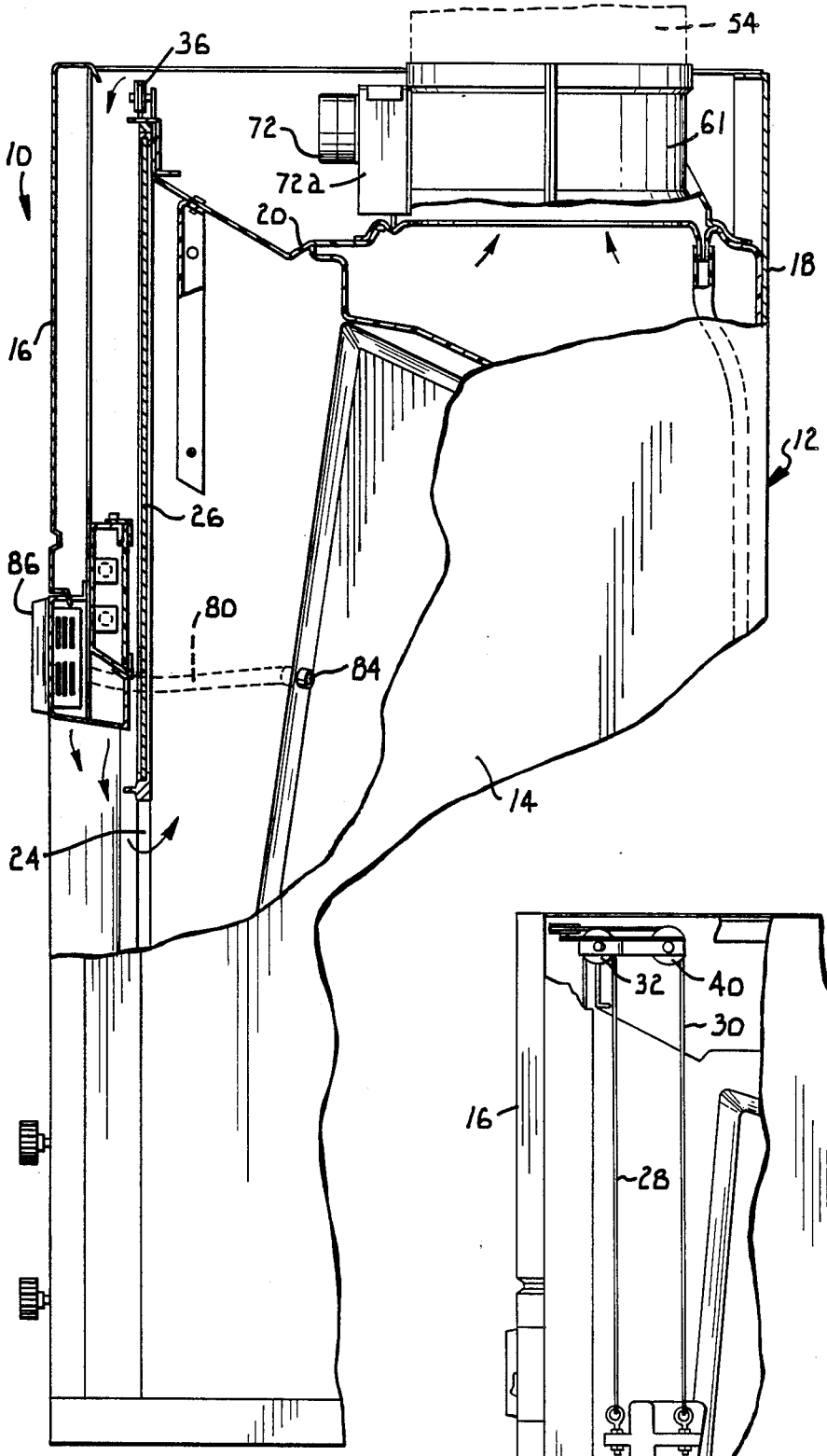
FIG. 3 is a fragmentary side elevational view of the fume hood, with portions broken away and shown in section for purposes of illustration and with the directional arrows indicating the pattern of air flow through the fume hood.
Figure 4:
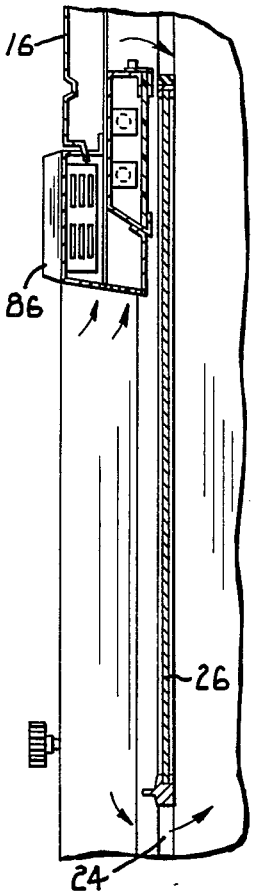
FIG. 4 is a fragmentary sectional view on an enlarged scale showing the area of the sash, with the sash lowered to a nearly closed position.

Referring now to the drawings in more detail and initially to FIGS. 1-3, numeral 10 generally designates a laboratory fume hood constructed in accordance with a preferred embodiment of the present invention. The fume hood 10 includes a cabinet 12 having opposite sides 14, a front panel 16, a back panel 18 (FIG. 3) and top and bottom panels 20 and 22, respectively. The bottom panel 22 provides a working surface upon which potentially harmful materials are handled, and it is accessible through a rectangular opening 24 in the front of the fume hood 10. A transparent sash 26 slides up and down to control the area of the opening 24 which is exposed.

Figure 5:
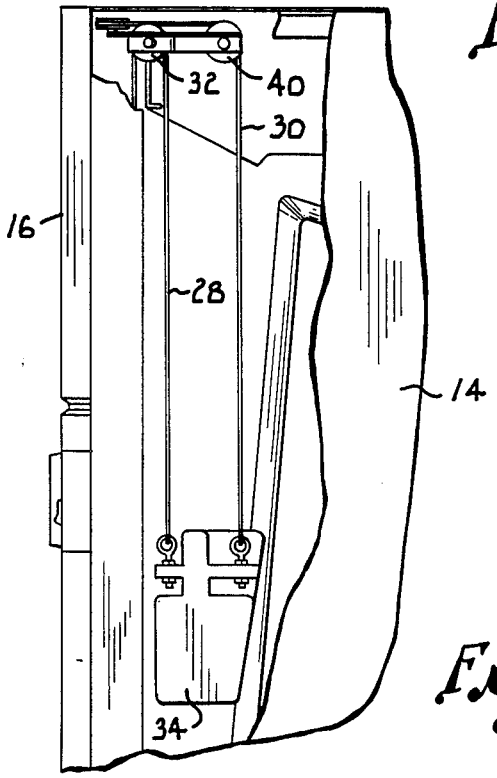
FIG. 5 is a fragmentary side elevational view of the fume hood, with a portion broken away for purposes of illustration.

The sash 26 is supported to slide up and down on the front of the cabinet 12. Flexible cables 28 and 30 are connected with the opposite sides of the top edge of the sash 26. As best shown in FIG. 5, cable 28 is drawn around a pulley 32 and is attached at its opposite end to a counterweight 34. As shown additionally in FIG. 7, the other cable 30 is drawn around a pulley 36 and extends across the top of the cabinet 12 to another pulley 38. Cable 30 is drawn around pulley 38 and is turned to the rear and drawn downwardly around another pulley 40. The end of cable 30 is attached to the counterweight 34. It is noted that the run of cable 30 which extends across the top of the cabinet moves in direct proportion to the sash, and the position of cable 30 thus provides a measure of the position of the sash.

Figure 7:
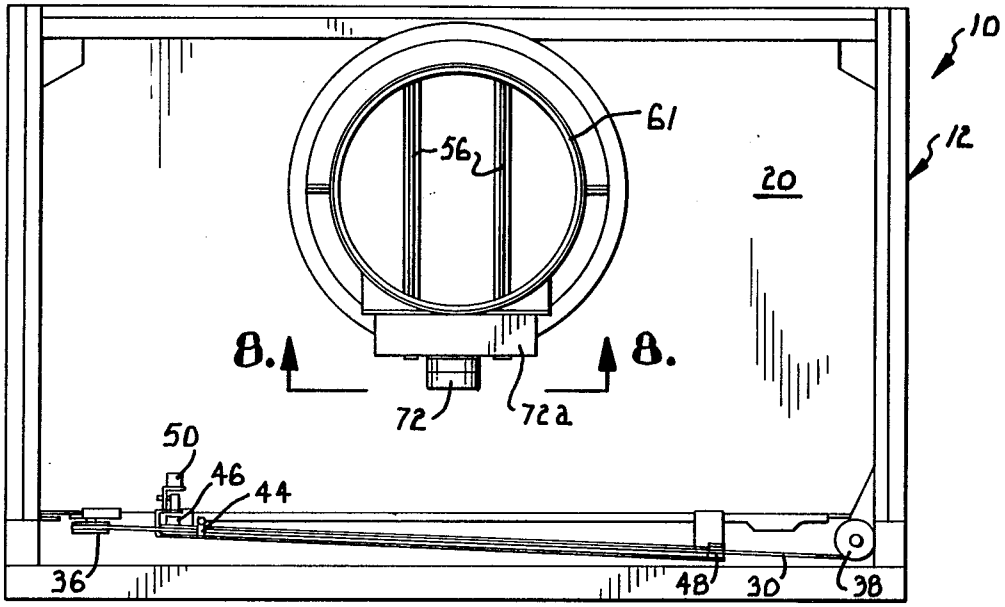
FIG. 7 is a top plan view of the fume hood.
Figure 10:
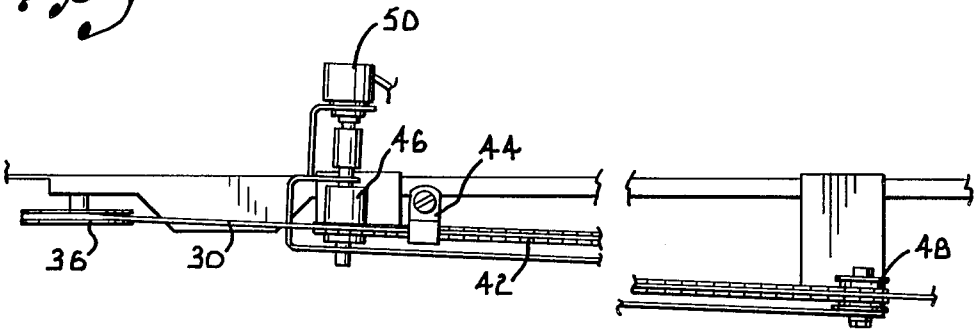
FIG. 10 is a fragmentary top plan view on an enlarged scale showing the sash position sensing potentiometer and the control system for it, with the break lines indicating continuous length.

With particular reference to FIGS. 7 and 10, cable 30 extends generally along a chain 42 and is secured to the chain by a clamp 44. The chain 42 is drawn around a pair of sprockets 46 and 48, and the sprockets 46 and 48 are thus rotated as chain 42 moves along with the cable 30.

Sprocket 46 drives a potentiometer 50 which provides a measure of the sash position. The potentiometer 50 is preferably a precision, ten-turn potentiometer. In exemplary form of the invention, the sash 26 has a range of movement of 26 inches. With one turn of the potentiometer unused at the fully open position of the sash and another turn unused at the fully closed position of the sash, eight turns of the potentiometer shaft is equated to 26 inches of sash motion. With a voltage cross potentiometer of 12 volts, the potentiometer has an output of 1.2 volts with the sash fully closed and 10.8 volts with the sash fully opened. Each inch of sash movement equals a change in the potentiometer output voltage of 0.369 volts.

An exhaust blower 52 (FIG. 1) pulls air through an exhaust duct 54 which communicates with the interior of the fume hood. The flow of air through the exhaust duct 54 is controlled by a damper which takes the form of two cooperating damper blades 56 (see FIGS. 8 and 9). Each damper blade 56 is mounted on a damper shaft 58, and the two damper shafts extend parallel to one another and are supported by bearings 60 mounted on a housing 61 for the damper.

Figure 8:
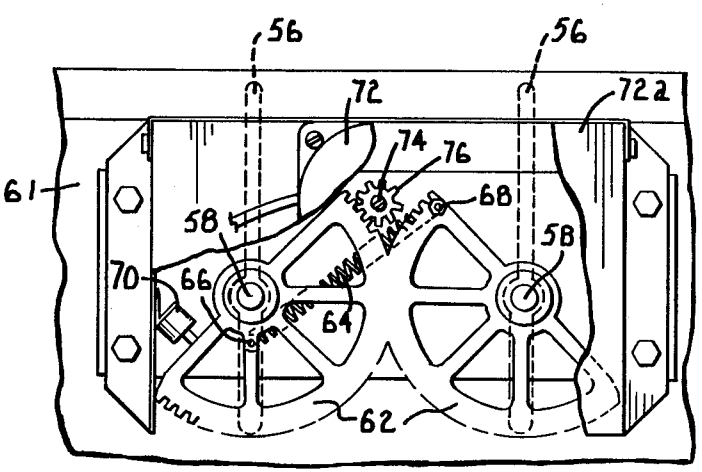
FIG. 8 is a fragmentary elevational view on an enlarged scale taken generally along line 8—8 of FIG. 7 in the direction of the arrows, with portions broken away for purposes of illustration.
Figure 9:
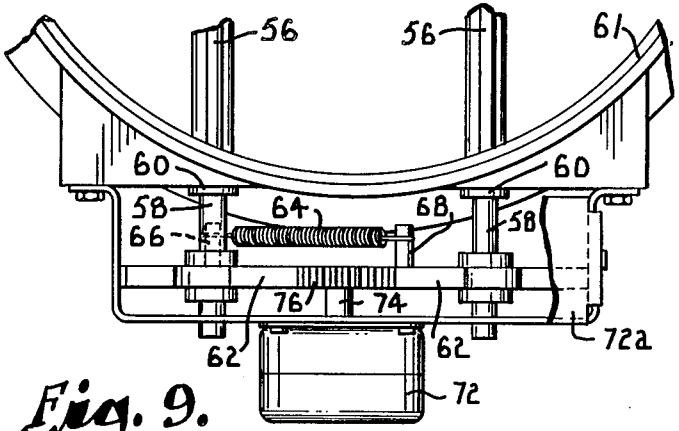
FIG. 9 is a fragmentary top plan view on an enlarged scale showing the stepping motor and associated components of the damper control system, with a portion broken away for purposes of illustration.

Each damper shaft 58 carries a semi-circular gear 62, and the two gears 62 are in meshing engagement in order to turn both damper blades 56 simultaneously and equidistantly but in opposite directions. The damper blades can turn between the fully open position shown in FIG. 8 wherein air can pass through the damper housing 61 substantially without restriction and a fully closed position wherein the two damper blades 56 cooperate to close off the damper housing 61. The two damper blades 56 rotate in opposite directions to move from the open to the closed position. The damper blade 56 which is situated on the left as viewed in FIG. 8 is turned in a counterclockwise direction toward the closed position, while the other damper blade 56 is turned in a clockwise direction toward the closed position.

The damper blades are continuously urged toward the fully open position by a tension spring 64. One end of spring 64 is hooked to a stud 66 which projects from the left hand gear 62 near its rotational axis. The opposite end of spring 64 is hooked to a stud 68 which is located on the right hand gear 62 well outboard of its rotational axis. As gears 62 turn during movement of the damper blades toward the closed position, stud 68 moves away from stud 66 and spring 64 is thus placed under increasing tension such that it continuously urges the gears to rotate the damper blades 56 toward the fully open position. In the fully open position, the left hand gear 62 depresses a switch 70 which is used to sense when the damper is fully open.

The damper blades 56 are controlled by a reversible electric stepping motor 72 which is mounted on a bracket **72*a* secured to the damper housing 61. The motor 62 has a rotatable output shaft 74 which is incrementally stepped in opposite directions when the stepping motor is energized in its opposite directional modes. The output shaft 74 carries a pinion 76 that meshes with one of the gears 62**.

The stepping motor 72 has an idle state in which it applies sufficient torque to the output shaft 74 to hold it in whichever position it assumes at the time. When the motor 72 is energized in one directional mode, it steps the output shaft 74 in incremental steps in one direction. In the opposite directional mode, the motor steps the output shaft in the opposite direction. When the motor is totally deenergized and receives no power, the holding torque on shaft 74 is released, and the shaft 74 can be turned freely in either direction under this condition. The motor 72 may be a unipolar, 4 phase motor that turns shaft 74 through 7.5 degrees per step.

When the blower 52 is in operation, the fume hood 10 is ventilated by pulling air through the fume hood opening 24 below the bottom edge of sash 26, through the fume hood interior and out through the exhaust duct 54. The flow is controlled by the position of the damper blades 56 which are in turn controlled by the stepping motor 72 which serves as an actuator for the damper.

Figure 6:
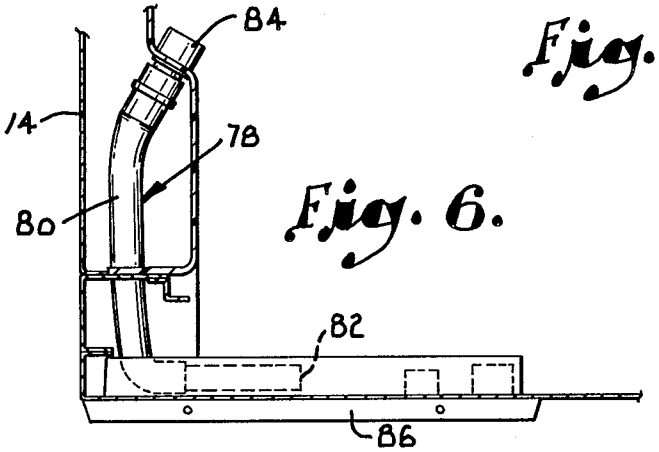
FIG. 6 is a fragmentary sectional view on an enlarged scale taken generally along line 6—6 of FIG. 2 in the direction of the arrows.

The face velocity of the air entering the fume hood opening 24 is sensed by a velocity sensor. The velocity sensor is generally identified by numeral 78 in FIG. 6 and takes the form of a tube 80 having its inlet end 82 located outside of the fume hood where it can sense the pressure in the area immediately outside of the opening 24. The opposite or outlet end 84 of tube 80 is located inside of the fume hood where it can sense the pressure within the fume hood interior. The velocity sensor 78 uses the pressure differential between the outside and the inside of the hood to sense the face velocity of the air entering the fume hood, and this velocity is converted by the sensor to an electrical signal having a voltage indicative of the face velocity.

The front face of the fume hood cabinet 12 is provided with a control panel 86 having various indicator lamps and switches which will be explained more fully. The control panel 86 is located immediately above the sash opening 24.

Figure 11:
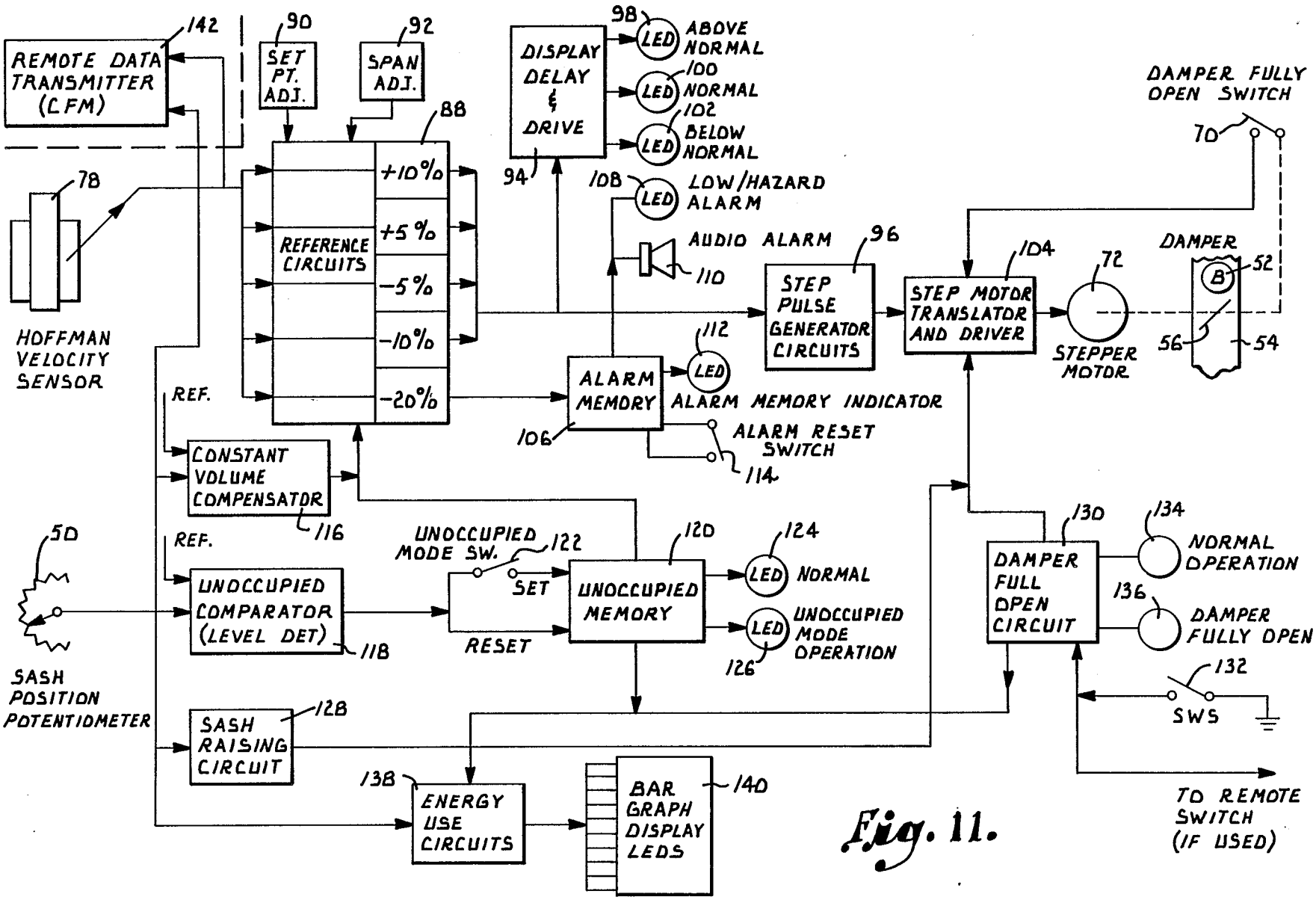
FIG. 11 is a functional block diagram of the components of the ventilation control system for the fume hood.

The control system which controls the ventilation of the fume hood 10 is shown in block diagram form in FIG. 11. In normal operation, the control circuit operates to maintain a constant face velocity through the opening 24 when the sash 26 is open far enough that more than 40 percent of the area of opening 24 is exposed. When the sash is closed to restrict the opening 24 to 40 percent or less of its maximum area, then the control system operates to maintain a constant volume rate of flow of ventilating air through the fume hood.

Referring to FIG. 11, the signal from the velocity sensor 78 is applied to a velocity comparator circuit 88 which includes five different comparators each having a different reference voltage applied to one of its inputs and the velocity sensor voltage applied to its other input. The desired face velocity for the ventilating air may be selected by a setpoint adjustment circuit 90. A span adjustment circuit 92 allows adjustment of the range about the velocity setpoint that is permitted by the system. For example, the face velocity may be set at 100 feet per minute, and the span adjustment circuit 92 may be set to allow the actual face velocity to depart from the set velocity by plus or minus 5 percent without corrective action being taken.

Four of the comparators in circuit 88 sense the face velocity and provide output signals to both a display delay and drive circuit 94 and to a step pulse generator circuit 96. Circuit 94 controls three velocity status lights 98, 100 and 102. If the actual face velocity is within plus or minus 5 percent of the velocity setting, the LED 100 is energized, and it preferably provides a green light to indicate that the face velocity is in the accepted normal range. If the face velocity is more than 5 percent above the set velocity, circuit 94 energizes the above normal LED 98 which may be an amber light. The third light 102 is also preferably an amber light, and it is energized when the actual face velocity is lower than 5 percent below the set velocity.

The step pulse generator circuit 96 converts the signals from circuit 88 into pulses which are applied to a step motor translator/driver circuit 104. If the signal received by circuit 96 indicates a departure from the set velocity between 5 and 10 percent above or below the set velocity, it applies approximately one pulse every two seconds to circuit 104. If the error is more than plus or minus 10 percent, circuit 96 applies approximately 2.5 pulses per second to the step motor translator/drive circuit 104.

Circuit 104 is preferably a specialized integrated circuit which converts the control signals from circuit 96 along with the appropriate directional signal into pulses having the correct sequence and duration to operate the stepping motor 72 in a manner to cause the motor to move the damper to correct the air flow conditions of the fume hood. When the error in the velocity signal sensed by the comparator circuits 88 is within plus or minus 5 percent, the motor 72 remains in the idle state and the damper is maintained in position. If the error is in the range of plus 5 percent to plus 10 percent or minus 5 percent to minus 10 percent, the relatively slow rate at which pulses are applied to the motor causes it to close or open the damper relatively slowly until the face velocity is again within the accepted range of plus or minus 5 percent of the set face velocity. If the error is greater than plus or minus 10 percent, the relatively fast rate at which pulses are applied to the stepping motor 72 causes it to close or open the damper relatively quickly in order to quickly bring the face velocity back within the normal range. Circuit 104 controls the phase of the signals applied to motor 72 in a manner to operate the motor in the proper directional mode.

The fifth velocity comparator in circuit 88 senses when the face velocity is lower than the set velocity by 20 percent or more. Then, it applies a signal to an alarm memory circuit 106. Preferably, delay is built in such that the unduly low face velocity must be sensed for a selected time interval (such as 30 seconds, for example) before the alarm memory circuit 106 is activated. The alarm memory circuit 106 overrides the normal status lights 98–102 and causes a red low/hazard alarm LED 108 to energize, thus indicating an alarm condition. In addition, the alarm memory 106 activates an audio alarm 110 which generates an audible alarm signal. If the face velocity rises again such that it is greater than 80 percent of the set velocity, LED 108 and the audio alarm 110 are deenergized.

It is a special feature of the invention that the alarm memory 106 controls another red LED 112 which provides an alarm indication that remains even if the flow returns to normal. LED 112 is energized whenever the actual face velocity drops below 80 percent of its setting, and LED 112 remains energized even if the face velocity thereafter rises back above 80 percent of the set velocity. The closing of an alarm reset switch 114 is the only way to deenergize LED 112. It is noted that the alarm reset switch 114 also deenergizes LED 108 and the audio alarm 110 if it is closed while the face velocity remains unduly low.

The status LEDs 98–102 indicative of the face velocity are arranged one above the other in a column on the control panel 86, as shown in FIG. 2. The alarm memory indicator LED 112 is located to one side of the status LED column, and the alarm reset switch 114 is located below the alarm memory indicator.

Referring again to FIG. 11, the output signal from the sash position potentiometer 50 is applied to a constant volume compensator circuit 116 which is a non-linear comparator/operational amplifier circuit that causes the hood to operate in a constant volume mode when the sash is closed below a preselected position, such as 40 percent open. So long as the output voltage from the potentiometer 50 is high enough to indicate that the sash is more than 40 percent open, circuit 116 is inactive. However, if the potentiometer voltage indicates that the sash is 40 percent open or less, circuit 116 adjusts the reference circuit voltages that are applied to the comparators in circuit 88. The reference voltage adjustment provided by circuit 116 changes with the sash position and causes the face velocity to be sufficient to maintain the volume rate of flow through the hood at a constant level equal to the rate at a 40 percent open sash position. It is noted that the amount of adjustment of the reference voltage that is required per inch of sash movement increase as the sash approaches the closed position. This variable adjustment feature is provided by a transistor and zener diode network in the circuit 116.

The fume hood 10 can be operated in an unoccupied mode if desired whenever the sash 26 is lowered to or below a preselected sash position such as six inches open, for example (equal to a potentiometer output signal of 3.4 volts). An unoccupied comparator circuit 118 receives the output signal from the potentiometer 50 and applies a reset signal to an unoccupied memory circuit 120 whenever the sash is raised high enough. The set input to the unoccupied memory 120 is applied through an unoccupied mode switch 122. When the sash is at or below six inches open and the unoccupied mode switch 122 is closed, circuit 120 provides an output signal that adjusts the reference circuit voltage applied to the comparators in circuit 88 in a manner to reduce the volume rate of flow that is normally maintained by circuit 116 in this range of fume hood operation.

By way of example, circuit 120 can reduce the volume rate of flow through the fume hood to one half of what it would be under the control of circuit 116 in normal operation. When the sash is raised above a seven inch open position, circuit 118 applies a reset signal to circuit 120 to automatically take the fume hood out of the unoccupied mode. Preferably, the set and reset points differ by approximately one inch of sash position to prevent unintended toggling of circuit 120. Circuit 120 controls a pair of status LEDs 124 and 126 which provide visual indications as to whether the fume hood is operating in the normal or the unoccupied mode of operation. LED 124 is preferably a green LED to indicate normal operation, while LED 126 may be an amber LED to indicate operation in the unoccupied mode.

A sash raising circuit 128 is provided to sense the speed of movement of the sash 26. The sash raising circuit 128 includes a comparator having a fixed reference voltage applied to one input. The other input to circuit 128 comes from the sash position potentiometer 50, with the position potentiometer voltage being coupled to the comparator through a differentiating circuit which provides a signal indicative of the derivative of the sash position and thus the sash speed. The comparator input signal is also directional so that if the sash is raised faster than a preestablished reference speed, the rash raising circuit 128 senses the abrupt opening of the sash and provides an output signal to circuit 104. This signal applied to circuit 104 causes it to immediately deenergize the stepping motor 72, and the spring 64 then immediately causes the damper blades 56 to move to the fully open position.

A damper full open circuit 130 is also provided. When active, circuit 130 applies a signal to circuit 104 causing immediate deenergization of stepping motor 72 and immediate springing of the damper blades 56 to the fully open position. Circuit 130 can be activated by a manual switch 132 on the front control panel and/or by a remote switch located some distance from the fume hood. Circuit 130 also controls a pair of status LEDs 134 and 136. LED 134 may be a green LED which is energized when the damper full open circuit is inactive, i.e., when the fume hood is in normal operation. The other LED 136 may be a red LED which is energized when circuit 130 is active in order to provide an indication that the damper is fully open and there is no automatic control of the damper face velocity.

As shown in FIG. 2, LEDs 124 and 126 are located on the control panel 86 one above the other above the unoccupied mode switch 122. LEDs 134 and 136 are likewise located on the control panel one above the other and above the damper full open switch 132.

An energy use circuit 138 receives a signal from the sash position potentiometer 50, and this potentiometer signal is modified by signals from the unoccupied memory circuit 120 and the damper full open circuit 130. The energy use circuit 138 serves as a driver for a display circuit 140 which provides a visual display of the relative energy used. Preferably, the display circuit 140 is a ten element bar graph display located on the control panel 86.

The output signals from the sash position potentiometer 50 and the velocity sensor 78 are applied to a remote data transmitter 142 which is sensitive to the volume rate of air flow out of the building through the fume hood 10. This information can be used to control air handling equipment so that the air that is lost through the fume hood can be made up by the air handling system of the building, thus maintaining a constant pressure in the laboratory that contains the fume hood.

In operation of the fume hood, the desired face velocity can be set by adjusting circuit 90, and the span or deadband can be selected by adjusting circuit 92. The control system then maintains a substantial constant face velocity through the fume hood opening 24 whenever the sash is more than 40 percent open. The stepper motor 72 is energized in the proper directional mode to move the damper blades 56 in the proper direction to open or close them depending upon whether the face velocity is too low or too high. The status LEDs 98, 100 and 102 provide an indication as to whether the face velocity is above normal, within the normal range, or below normal. If the face velocity drops to an unacceptably low level, the LEDs 108 and 112 are activated along with the audio alarm 110, thus alerting personnel in the laboratory to the fact that a potentially dangerous situation exists. If there is only a temporary condition causing an alarm situation, LED 108 and audio alarm 110 are deenergized as soon as the velocity increases to a safe level. However, LED 112 remains energized until the alarm reset switch 114 is depressed. Consequently, if the laboratory is unoccupied when an alarm condition occurs, LED 112 alerts returning lab personnel to the fact that there has been an alarm situation that may require attention.

When the sash 26 is 40 percent open or less, the action of the constant volume compensator circuit 116 causes the fume hood to operate in a constant volume rate of flow mode. Thus, in the range of operation below 40% open, the amount of air flow through the hood remains at its level at 40 percent open so that sufficient air flow through the fume hood occurs at all times to avoid unsafe operating conditions.

If the sash is abruptly opened, circuit 128 senses that fact and immediately causes the damper to open fully so that maximum ventilation is immediately provided to avoid the possibility of contaminants escaping from the fume hood before the system has been able to sense the decrease in face velocity or volume rate of flow. Similarly, in the event of an accidental spill or other emergency situation, switch 132 can be depressed to immediately cause the damper to open fully so that maximum ventilation is immediately provided.

Overnight and on weekends when the laboratory is unoccupied, the sash can be nearly fully closed and the unoccupied mode switch 122 can be operated to place the fume hood in the unoccupied mode. Then, energy savings are achieved by the reduced air flow through the fume hood. As soon as the laboratory personnel return and raise the fume hood, the control system automatically and immediately reverts to normal operation from the unoccupied mode to avoid possible safety problems when the laboratory is occupied.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a fume hood having an opening, a movable sash for controlling the area of the opening that is exposed, and adjustable ventilating means for ventilating the fume hood, the improvement comprising:
   - means for sensing the velocity of air entering the fume hood opening;
   - means responsive to the sash position for sensing the exposed area of the fume hood opening;
   - means for adjusting said ventilating means in a manner to maintain the velocity of air entering the opening at a substantially constant preselected level when the exposed area of the opening is greater than a preselected area; and
   - means for adjusting said ventilating means in a manner to maintain the volume rate of air entering the opening at a substantially constant preselected rate when the exposed area of the opening is less than said preselected area.

2. The improvement of claim 1, including means for adjusting said preselected level of the air velocity.

3. The improvement of claim 1, including:
   - switch means selectively operable to effect an unoccupied mode of the fume hood; and
   - means for adjusting said ventilating means in a manner to maintain the volume rate of air entering at a substantially constant rate less than said preselected rate in the unoccupied mode of the fume hood.

4. The improvement of claim 3, including means for disabling said switch means to preclude operation in the unoccupied mode unless the exposed area of the opening is less than a predetermined area which is less than said preselected area.

5. The improvement of claim 4, including means for automatically terminating operation in the unoccupied mode when the sash is positioned to expose more than said predetermined area of the fume hood opening.

6. The improvement of claim 3, including means for visually indicating when the fume hood is operating in the unoccupied mode.

7. The improvement of claim 1, including means for visually indicating when the velocity of air entering the opening departs from said preselected level by more than a predetermined range.

8. The improvement of claim 7, wherein said visual indicating means includes separate means for visually indicating when the air velocity is outside of said predetermined range on the high side and on the low side.

9. The improvement of claim 1, including means for providing an alarm signal when the velocity of air entering the opening drops to a level which is below said preselected level by a predetermined amount.

10. The improvement of claim 9, wherein:
   - said alarm signal includes first and second indicators providing an indication of an alarm condition when energized;
   - both of said indicators are energized when the air velocity is below said preselected level by said predetermined amount;
   - said first indicator is deenergized when the air velocity rises back within said predetermined amount of said preselected level; and
   - said second indicator remains energized if the air velocity rises back within said predetermined amount of said preselected level.

11. The improvement of claim 10, including an alarm reset switch operable to deenergize said second indicator.

12. The improvement of claim 1, including:
   - means for sensing the speed of movement of the sash; and
   - means for effecting a maximum flow rate of air through said opening when the sash is moved at a speed greater than a predetermined speed in a direction to increase exposure of the opening.

13. A method of controlling ventilation of a fume hood having an opening and a movable sash for controlling exposure of said opening, said method comprising the steps of:
   - sensing the velocity of the air entering the fume hood through said opening;
   - sensing the sash position to detect the exposed area of the opening;

maintaining the velocity of air flowing into said opening substantially constant when the exposed area of the opening is greater than a preselected area; and maintaining the volume rate of air flow into said opening substantially constant when the exposed area of the opening is less than said preselected area.

14. The method of claim 13, including the steps of:

effecting an unoccupied mode of the fume hood;

terminating the unoccupied mode whenever the sash is positioned to expose more than a predetermined area of the opening which is less than said preselected area; and decreasing the volume rate of air flow into said opening to a minimum level when the fume hood is operating in the unoccupied mode.

15. The method of claim 13, including the steps of:

establishing a velocity range about said constant velocity;

visually indicating when the air velocity into the opening is outside of said range on the high side thereof; and visually indicating when the air velocity into the opening is outside of said range on the low side thereof.

16. The method of claim 13, including the steps of:

generating first and second alarm signals when the air velocity into the opening drops to a selected level below said constant velocity; and terminating said first alarm signal while maintaining said second alarm signal if the air velocity into the opening rises back above said selected level.

17. The method of claim 13, including the steps of:

sensing the speed of movement of the sash; and increasing the flow of air through the opening to a maximum rate in response to sash movement above a preselected speed in a direction to increase the exposed area of the opening.

18. In a fume hood having an opening, a movable sash for controlling the area of the opening that is exposed, an exhaust duct, and a damper in the exhaust duct movable between a fully open position and a fully closed position, the improvement comprising:

means for sensing the speed of movement of the sash; and means for effecting immediate movement of the damper to the fully open position thereof in response to movement of the sash above a preselected speed in a direction to increase the exposure of the opening.

* * * * *